US006696628B2

(12) United States Patent
Yoshida

(10) Patent No.: US 6,696,628 B2
(45) Date of Patent: Feb. 24, 2004

(54) MUSICAL INSTRUMENT STAND

(75) Inventor: Tomonori Yoshida, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 0 days.

(21) Appl. No.: 10/214,967

(22) Filed: Aug. 8, 2002

(65) Prior Publication Data

US 2003/0029299 A1 Feb. 13, 2003

(30) Foreign Application Priority Data

Aug. 8, 2001 (JP) ..... 2001-241362
Jul. 25, 2002 (JP) ..... 2002-216429

(51) Int. Cl.[7] ..... G10D 3/00
(52) U.S. Cl. ..... 84/321
(58) Field of Search ..... 84/327, 329, 421, 84/403, 312 P; 248/443

(56) References Cited

U.S. PATENT DOCUMENTS 4,848,207 A 7/1989 Kawai
4,881,442 A 11/1989 Stevens
5,479,843 A * 1/1996 Yanagisawa ..... 84/403
6,096,955 A * 8/2000 Ter Heide ..... 84/421

FOREIGN PATENT DOCUMENTS

JP 2-45913 12/1990
JP 11-242479 9/1999

* cited by examiner

*Primary Examiner*—Kimberly Lockett
(74) *Attorney, Agent, or Firm*—Koda & Androlia

(57) ABSTRACT

A musical instrument stand for, for instance, marimbas comprised of a musical instrument mounting holder and a stand main body. The musical instrument mounting holder is connected at its bottom to height adjustment devices, which are installed in the leg columns of the stand main body, with an angle adjustment mechanism which is, for instance, an universal joint, in between, thus allowing the musical instrument mounting holder to take a desired degree of angle with respect to the leg columns and tilt to the front or rear and to the left or right.

11 Claims, 9 Drawing Sheets

MUSICAL INSTRUMENT STAND

BACKGROUND OF THE INVENTION

1. Field of the Invention

The present invention relates to a stand for a musical instrument and more particularly to a musical instrument stand used for, for example, marimbas, xylophones and vibraphones.

2. Prior Art

FIG. 9 is a schematic perspective view of a conventional marimba set with some of the components omitted.

The marimba set 1 includes a musical instrument stand 4 that is comprised of a musical instrument mounting holder 2 and a stand main body 3. The stand main body 3 supports the musical instrument mounting holder 2 so that the height of the holder 2 can be adjusted. A plurality of tone bars 5 and resonator tubes 6 are mounted on the musical instrument mounting holder 2. At the time of playing, the height of the musical instrument mounting holder 2 is changed in accordance with the height and preference, etc. of the person playing the instrument.

Various types of stands have been proposed in the past as musical instrument stands that support a musical instrument mounting holder in a height adjustable fashion. The musical instrument stands disclosed in Japanese Utility Model Application Laid-Open (Kokai) Nos. 2-43913 and 63-62896 (corresponding to U.S. Pat. No. 4,848,207) and Japanese Patent Application Laid-Open (Kokai) Nos. 1-116695 (corresponding to U.S. Pat. No. 4,881,442) and 11-242479 are typical examples of such musical instrument stands.

For example, the musical instrument stand described in Japanese Patent Application Laid-Open (Kokai) No. 11-242479 uses a direct action type gas spring as a height adjustment device. The height adjustment device, utilizing gas pressure, supports the musical instrument mounting holder so that the height of the holder can be adjusted. The gas springs are built into the respective leg columns of the stand main body.

More specifically, in the above-described conventional musical instrument stand 4, as seen from FIG. 9, a total of four leg columns 7, i.e., two each on the low-tone side and high-tone side, are disposed on the stand main body 3. The musical instrument mounting holder 2 is horizontally mounted on the upper ends of these leg columns 7. In cases where the height of the musical instrument mounting holder 2 is to be adjusted, the adjustment is accomplished by raising or lowering the respective leg columns 7 on the high-tone side and low-tone side one side at a time by way of using elastic deformation and an extra margin in the dimensions of the respective elements that make the stand main body 3.

However, in the case of an integrated musical instrument mounting holder in which lateral frames 8 and longitudinal (or side) frames 9 that form the musical instrument mounting holder 2 are disassembled, it is difficult to raise and lower the leg columns 7 one side at a time. Accordingly, it is necessary to raise both sides simultaneously. Especially for a musical instrument that has a great number of tone bars and is thus long in the left-right (lateral) direction, such an adjustment needs a team of two persons.

SUMMARY OF THE INVENTION

The present invention solves the above-described problems with the conventional musical instrument stand.

It is an object of the present invention to provide a musical instrument stand in which the angle between a musical instrument mounting holder and a stand main body is changeable.

It is another object of the present invention to provide a musical instrument stand in which the stress, which is generated in the joint portions between the lateral frames and the side frames of the musical instrument mounting holder and in the joint portions between the musical instrument mounting holder and stand main body, when the height is adjusted, is alleviated.

It is still another object of the present invention to provide a musical instrument stand in which the adjustment of the height is facilitated, and a playing environment can be created so as to suit the preference of the person playing the musical instrument.

The above objects are accomplished by a unique structure for a musical instrument stand that supports a musical instrument mounting holder by means of a stand main body so that the height of the musical instrument mounting holder is adjusted; and in the present invention, the musical instrument mounting holder is supported by an angle adjustment mechanism so that the angle of the musical instrument mounting holder, relative to the stand main body, is adjusted.

In this structure of the present invention, no strain is generated in the musical instrument mounting holder when the musical instrument mounting holder is inclined during the height adjustment of the musical instrument mounting holder. Thus, the stress that would generate in the joint portions between the lateral frames and the side frames that make the musical instrument mounting holder and in the joint portions between the musical instrument mounting holder and the stand main body can be alleviated. In addition, it is possible to set the musical instrument on the musical instrument mounting holder inclined at an angle preferred by the person playing the musical instrument.

In the above structure, the angle adjustment mechanism supports the musical instrument mounting holder so that the angle of the musical instrument mounting holder is adjusted in its front-rear direction or in its left-right direction.

In other words, the angle adjustment mechanism allows the musical instrument mounting holder to be inclined in the front-rear direction or in the left-right direction.

In the above structure, the angle adjustment mechanism supports the musical instrument mounting holder in such a manner that the angle of the holder can be adjusted in any desired direction. This is accomplished by the use of a universal joint as the angle adjustment mechanism.

Accordingly, in the present invention, the musical instrument mounting holder can be inclined in the front-rear or left-right directions. When the leg columns on the front side of the stand main body are set to be lower than the leg columns on the rear side, the musical instrument mounting holder inclines toward the player, so that a new playing environment can be created.

DETAILED DESCRIPTION OF THE INVENTION

Figure 1:
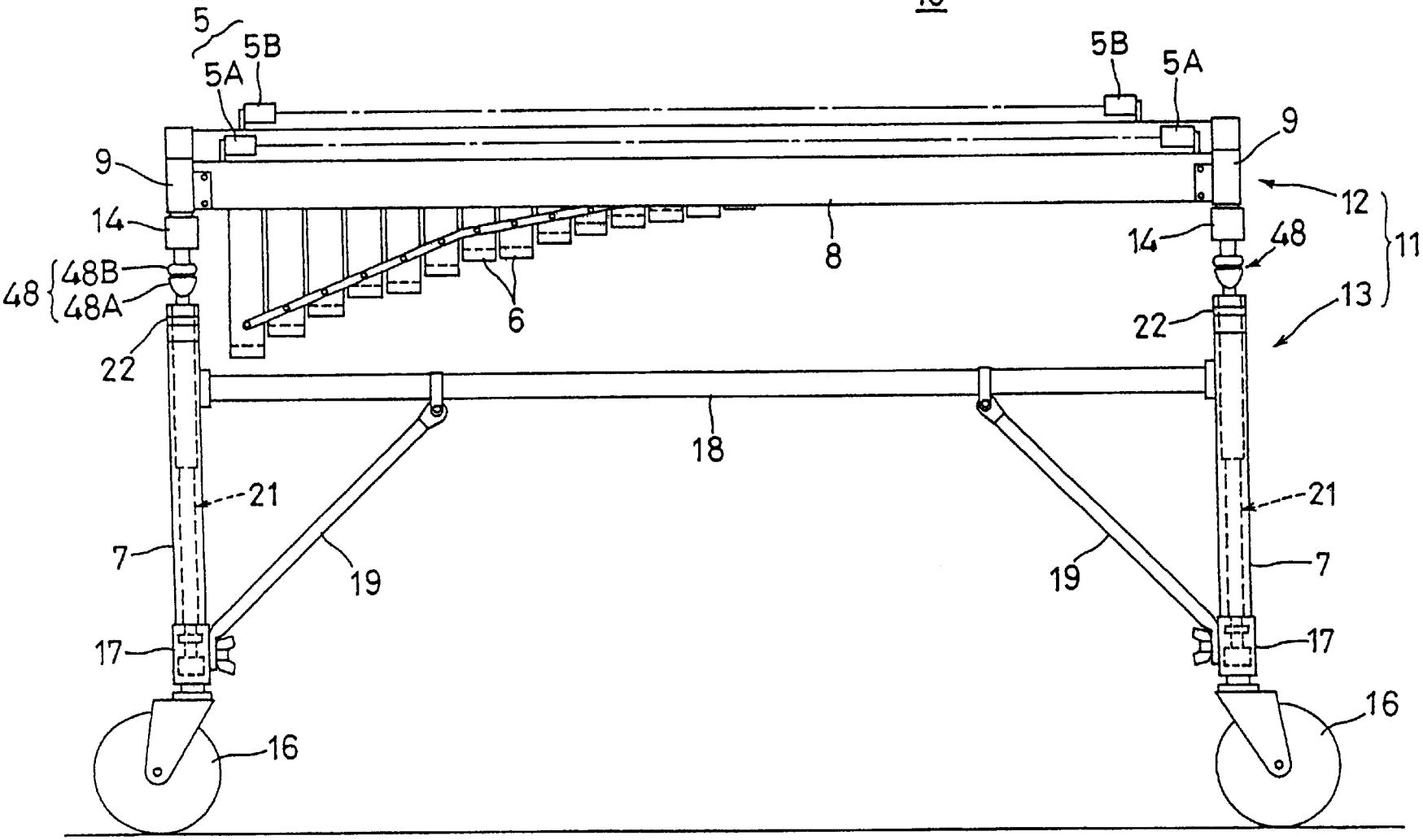
FIG. 1 is a schematic front view of one embodiment of the present invention applied to a musical instrument stand for marimbas.

The present invention will be described in detail below with reference to the embodiments illustrated in the accompanying drawings.

In FIGS. 1 through 5, the marimba set, which is referred to as a whole with the reference numeral 10, is constructed from respective pluralities of tone bars 5 and resonator tubes 6 as well as a musical instrument stand 11 on which the tone bars 5 and resonator tubes 6 are provided. The musical instrument stand 11 is comprised of a musical instrument mounting holder 12, on which the tone bars 5 and resonator tubes 6 are mounted, and a stand main body 13, which supports the musical instrument mounting holder 12 so that the height of the holder 12 is adjusted (or changed).

The tone bars 5 include a plurality of natural-tone bars 5A (disposed on the front side where the player stands) and a plurality of accidental-tone bars 5B (disposed on the rear side), and they are disposed in two rows (front and back) on the upper surface of the musical instrument mounting holder 12. The natural-tone bars 5A and accidental-tone bars 5B are formed with through-holes that extend in the direction of width thereof at locations that correspond to nodes of the primary (fundamental) vibration, and they are supported by strings (not shown) that pass through these through-holes.

The resonator tubes 6 include a plurality of natural-resonator tubes 6A (disposed on the front side) and accidental-resonator tubes 6B (disposed on the rear side). The resonator tubes 6 increase the sound volume by making vibrations in resonance with the respective natural-tone bars 5A and accidental-tone bars 5B and are respectively suspended beneath the corresponding natural-tone bars 5A and accidental-tone bars 5B. The natural-resonator tubes 6A and accidental-resonator tubes 6B open at the upper ends and closed at the lower ends. These resonator tubes 6 have substantially the same characteristic frequencies as the primary frequencies of the corresponding natural-tone bars 5A and accidental-tone bars 5B.

The musical instrument mounting holder 12 is a rectangular frame-form body which is long in the left-right (lateral) direction in FIG. 1. The musical instrument mounting holder 12 is comprised of a total of four long lateral frames 8, a pair of side frames 9, and a pair of bridge members 14. One set of two lateral frames 8 are disposed beneath the natural-tone bars 5A, and another set of two lateral frames 8 are disposed beneath the accidental-tone bars 5B. The pair of side frames 9 (provided on the left and right sides) connect the end portions of the lateral frames 8, and a pair of bridge members 14 (provided on the left and right sides) are fastened to the undersurfaces of the respective side frames 9.

The stand main body 13 is comprised of a pair of (left and right side) leg elements 17 disposed parallel and equipped with casters 16 and a total of four leg columns 7 respectively installed (two each) in a vertical attitude on the respective leg elements 17. In the shown embodiment, the leg elements 17 are disposed parallel to the length of the tone bars 5A. The stand main body 13 further includes horizontal connecting bars 18, which connect the upper portions of the leg columns 7 to each other, and stays 19, which diagonally connect the connecting bars 18 and respective leg elements 17.

The leg columns 7 are hollow cylinders, and they are each equipped with a height adjustment device 21 and a stopper 22. The height adjustment device 21 adjusts the height of the musical instrument mounting holder 12, and the stopper 22 anchors the musical instrument mounting holder 12 in a desired height position with respect to the leg column 7.

More specifically, each one of the height adjustment devices 21 is substantially a direct action type gas spring that uses gas pressure and is installed inside the respective leg columns 7.

Figure 3:
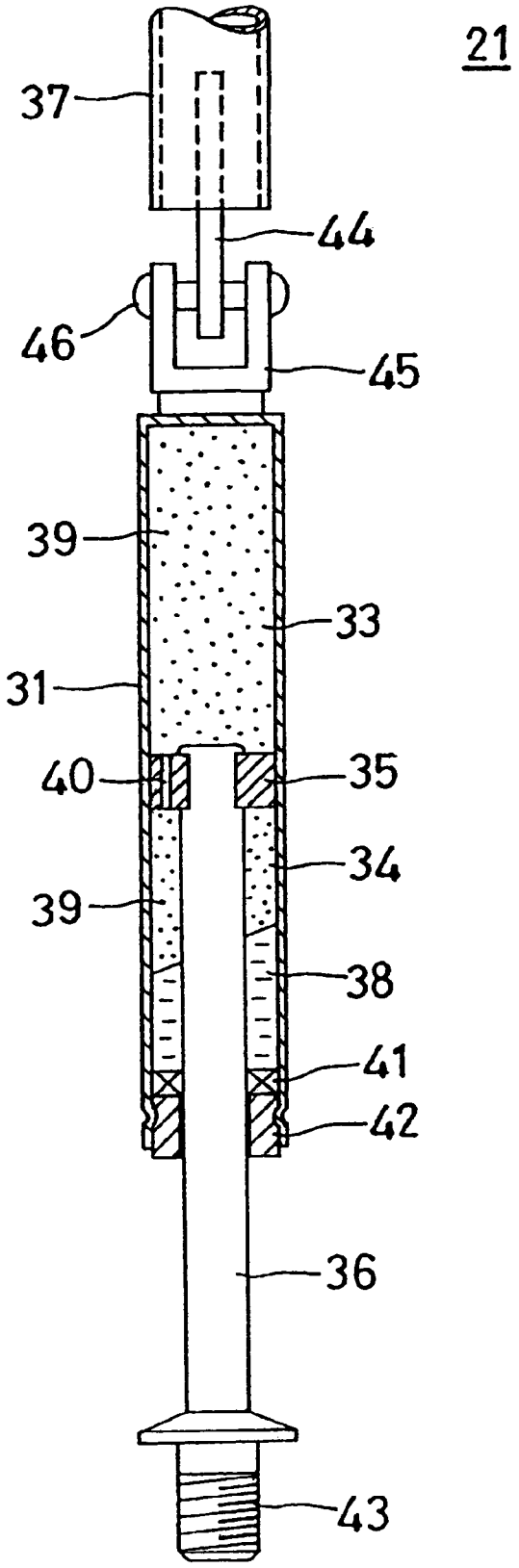
FIG. 3 shows, in cross section, one of the height adjustment devices.
Figure 4:
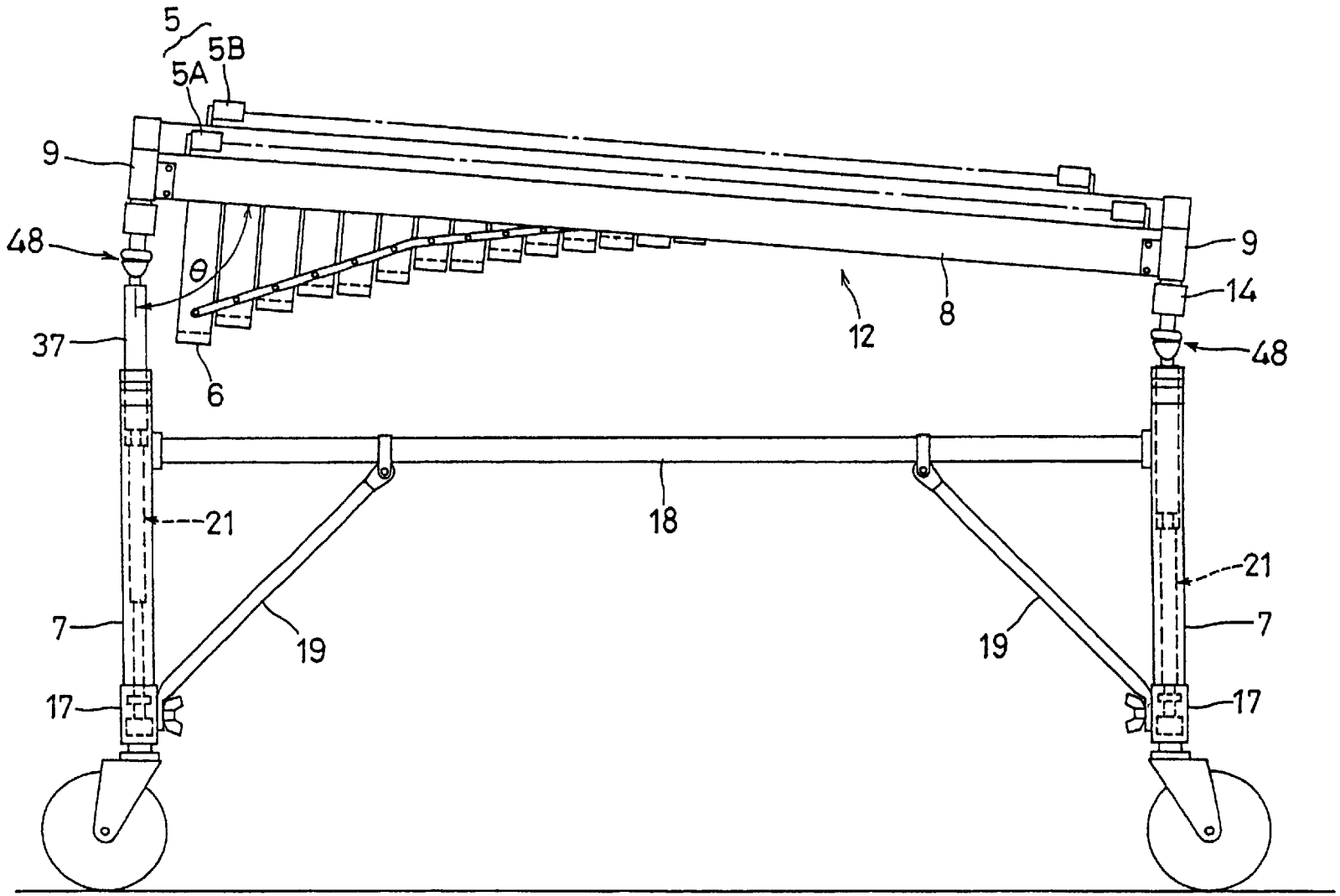
FIG. 4 is a front view of the musical instrument stand with its left side raised so that the musical instrument mounting holder is tilted to the right side.

As seen from FIG. 3, the height adjustment device 21 is comprised of a cylinder 31, a piston 35 provided inside the cylinder 31 and partitions the interior of the cylinder 31 into two chambers 33 and 34, a piston rod 36 having the piston 35 at its upper end, and a supporting member 37 mounted on the cylinder 31.

The cylinder 31 is free to slide in the vertical direction with respect to the piston rod 36; and the piston 35 is disposed slidable inside the cylinder 31. Oil 38, such as a silicone oil, and a high-pressure gas 39, such as nitrogen gas, are sealed inside the cylinder 31. The piston 35 has an orifice 40 that communicates the first and second chambers 33 and 34 with each other. The piston rod 36 protrudes from the bottom of the cylinder 31 passing through a sealing member 41 and rod guide 42 disposed inside bottom of the cylinder 31. The piston rod 36 is formed at a bottom thereof with an external thread 43, and the bottom of the piston rod 36 is screwed with a nut and brought into the leg element 17. The supporting member 37 is disposed in an upright attitude in the leg column 7 with its upper end protruding above the leg column 7. The bottom of the supporting member 37 is connected to a connecting plate 44, and the connecting plate 44 is connected by a rivet 46 to a connecting member 45 that is fastened to the top surface of the cylinder 31.

Furthermore, universal joints 48 are respectively attached to the upper end of each supporting member 37. The universal joints 48 are used as an angle adjustment mechanism that supports the musical instrument mounting holder 12 and allows the holder 12 to tilt in any desired direction.

More specifically, each universal joint 48 of the shown embodiment is a ball type universal joint; and it is comprised of a spherical surface seat 48A, which is of a bowl shape and fastened to the upper surface of the supporting member 37, and a spherical surface element 48B, which is attached to the undersurface of the bridge member 14 and has a spherical surface portion that slidably engages with the spherical-surface seat 48A. The present invention is not limited to this type of universal joint. It goes without saying that any type of universal joint can be used in the present invention.

The stopper 22 is, for instance, a tapered nut; and it is screw-engaged with a tapered screw (not shown) formed on the outer circumferential surface of the upper end portion of the leg column 7. When the stopper 22 is tightened so that the upper end portion of the leg column 7 is reduced in diameter and pressed against the outer circumference of the supporting member 37, the height adjustment device 21 is locked.

A plurality of slits (not shown) are formed in the upper end portion of the leg column 7 so as to extend in the axial direction of the leg column 7. Thus, when the stopper 22 is tightened, the upper end of the leg column 7 is reduced in its diameter and thus securely holds the supporting member 37.

Instead of a tapered nut, a screw can be used as the stopper 22. When a screw is used as the stopper 22, the screw is screw-engaged with the outer circumference of the leg column 7, so that the tip end of the screw protruding into the interior of the leg column 7 is pressed against the outer circumference of the supporting member 37. In case of use of such a screw, a plurality of annular grooves can be formed in the outer circumference of the supporting member 37 at a specified spacing in the direction of the length (or axis). When this grooved supporting member 37 is used, the tip end of the screw is bought so as to engage with one of the arbitrarily selected grooves, so that the supporting member 37 is securely anchored. Thus, with this grooved supporting member 37, the height of the musical instrument mounting holder 12 can be adjusted stepwise.

In the above embodiment, with the use of the stopper 22 which is a tapered nut, the leg column 7 is reduced in its diameter, thus locking the height adjustment device 21. However, in the present invention, other types of locking mechanisms, such as a crutch mechanism used in a stand for a drum set, can be employed. This crutch mechanism (not shown) for a drum set typically includes a fixing member and a resin cylindrical member that covers the stopper from outside and is formed with a slit. The crutch mechanism is fitted on the leg column 7, and the supporting member 37 is inserted in the cylindrical member. When a holding screw on the leg column 7 is tightened so that the fixing member is pressed against the slit, the cylindrical member is reduced in diameter, thus squeezingly gripping the supporting member 37 on the leg column 7.

Next, the operation to adjust or alter the height of the musical instrument mounting holder will be described.

Figure 2:
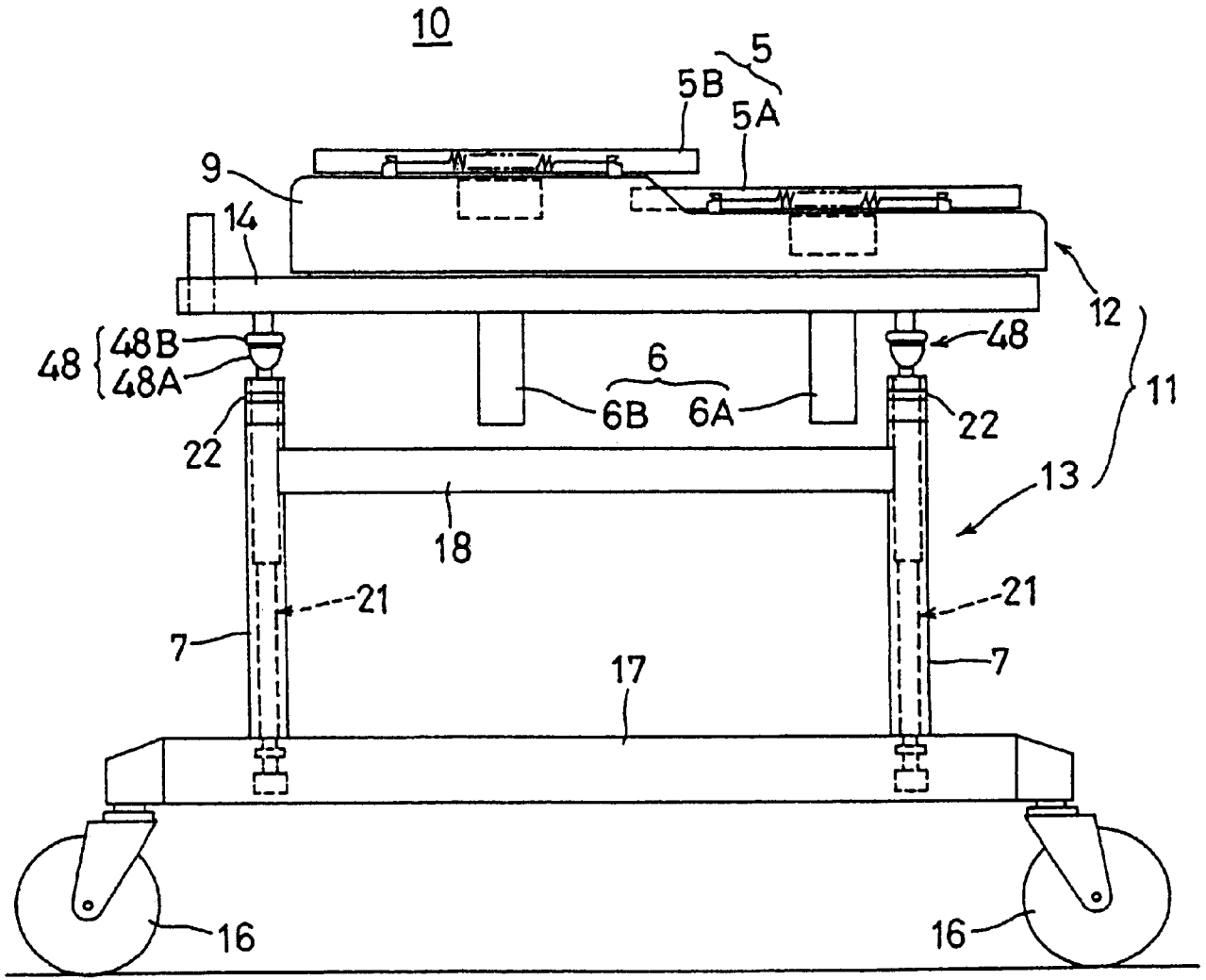
FIG. 2 is a left-side view thereof.

FIGS. 1 and 2 show the state in which the musical instrument mounting holder 12 is held at the lowermost position by the stoppers 22. In this state, the cylinders 31 of the height adjustment devices 21 installed in four leg columns 7 are at the lowermost position. Accordingly, the volume inside the respective first chambers 33 is at a minimum, the pressure of the gas 39 is at a maximum, and the cylinders 31 are driven upward. The majority of the high-pressure gas 39 inside the first chambers 33 has moved into the second chambers 34 through the orifices 40, and the silicone oil 38 is compressed.

In order to adjust the height of the musical instrument mounting holder 12 so as to raise it, the stoppers 22 are loosened, thus releasing the supporting members 37 which has been locked by the stoppers 22.

When the supporting members 37 locked by the stoppers 22 are thus released, the gas pressure inside the first chambers 33 acts as a driving force so that the cylinders 31 are pushed upward. If the driving force of the height adjustment devices 21 at this time is greater than the total weight of the tone bars 5, resonator tubes 6, musical instrument mounting holder 12, cylinders 31 and supporting members 37, then the musical instrument mounting holder 12 can be automatically raised by the height adjustment devices 21. If, on the other hand, the driving force is smaller than the total weight, the player can raise the musical instrument mounting holder 12 by way of applying a light upward force, which corresponds to the difference between the driving force and the total weight, to the musical instrument mounting holder 12.

Then, when the musical instrument mounting holder 12 is raised to a desired height, the stoppers 22 are tightened back, so that the supporting members 37 are locked at this height position. When the cylinders 31 are raised by the gas pressure inside the first compartments 33, the volume of the second compartments 34 gradually decreases, and the silicone oil 38 is compressed. As a result, the high-pressure gas 39 inside the second compartments 34 moves into the first compartments 33 through the orifices 40.

In the above operation, even when the supporting members 37 are raised at the upper most position, the lower ends of the supporting members remain inside the leg columns 7.

In order to lower the musical instrument mounting holder 12 from an appropriate height position to a lower or the lowermost position, the stoppers 22 are loosened, thus releasing the supporting members 37.

When the supporting members 37 are released by the stoppers 22, the musical instrument mounting holder 12 lowers by its own weight if the gas pressure of the height adjustment devices 21 is smaller than the total weight of the tone bars 5, resonator tubes 6, musical instrument mounting holder 12, cylinders 31 and supporting members 37. In this case, the gas pressure of the height adjustment devices acts to brake the musical instrument mounting holder 12, and an abrupt drop of the musical instrument mounting holder 12 is prevented. In cases, on the other hand, where the gas pressure is greater than the total weight, the musical instrument mounting holder 12 can be pushed down by hand (by the player).

As the musical instrument mounting holder 12 is lowered, the cylinders 31 are also lowered, so that the gas pressure inside the first compartments 33 gradually increases and acts to push the musical instrument mounting holder 12 upward. Accordingly, the musical instrument mounting holder 12 is pushed downward by hand just before this musical instrument mounting holder 12 is lowered to a desired position or to the lowermost position; and when the musical instrument mounting holder 12 is lowered to a desired position or to the lowermost position, the stoppers 22 are tightened so that the supporting members 37 are fastened and locked to the leg columns 7.

In adjusting the height of the musical instrument mounting holder 12 by means of the height adjustment devices 21, it is difficult to operate all of the height adjustment devices 21 installed in four leg columns 7 at the same time. Ordinarily, therefore, the two height adjustment devices 21 on either the left or right side, e.g., the two height adjustment devices 21 in the two leg columns 7 on the low-tone side (left side in FIG. 1), are operated at substantially the same time so that the low-tone side of the musical instrument mounting holder 12 is raised by a specified amount, after which the two height adjustment devices 21 in the two leg columns 7 on the high-tone side (right side) are operated at substantially the same time so that the high-tone side of the musical instrument mounting holder 12 is raised by a specified amount, thus bringing the musical instrument mounting holder 12 into a substantially horizontal attitude.

Figure 9:
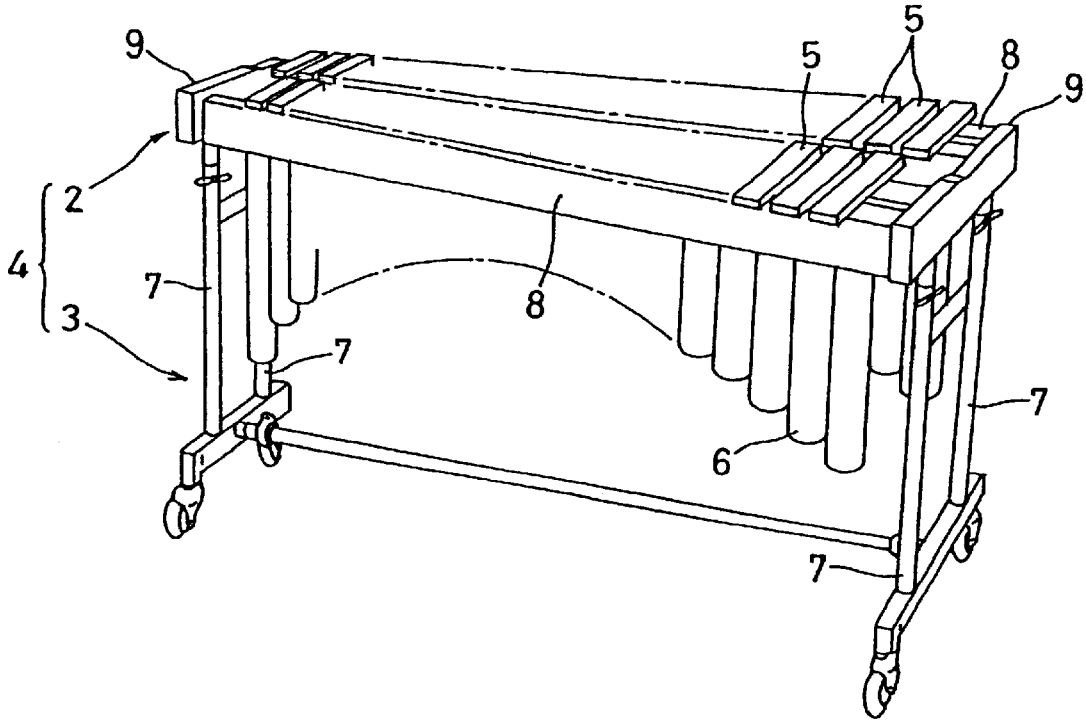
FIG. 9 PRIOR ART
FIG. 9 is an external perspective view of a conventional musical instrument stand.

In this operation, since the musical instrument stand 11 is endowed with a degree of freedom in the angles between the leg columns 7 and the musical instrument mounting holder 12 by the universal joints 48, no strain is generated as a result of excessive tilting as in conventional musical instrument stands. In other words, in the conventional musical instrument stand 4 shown in FIG. 9, the angle formed by each of the leg columns 7 and the musical instrument mounting holder 2 is fixed at 90°; accordingly, if an attempt is made to push the musical instrument mounting holder 2 upward one side at a time, the musical instrument mounting holder 2 is excessively tilted with respect to the leg columns 7, and strain is generated. Furthermore, the musical instrument mounting holder 2 will not be raised unless both sides thereof are lifted at the same time.

On the other hand, in the musical instrument stand 11 that has a structure endowed with a degree of freedom in the angles between the leg columns 7 and the musical instrument mounting holder 12 by the universal joints 48 according to the present invention, the respective angles θ (see FIG. 4) between the leg columns 7 and the musical instrument mounting holder 12 can vary as a result of the action of the universally joints 48 when one side of the musical instrument mounting holder 12 is raised or lowered. Accordingly, no strain is generated in the musical instrument mounting holder 12; and thus, the height can be adjusted one side at a time, and the musical instrument mounting holder 12 can be easily raised or lowered by a single person.

Figure 5:
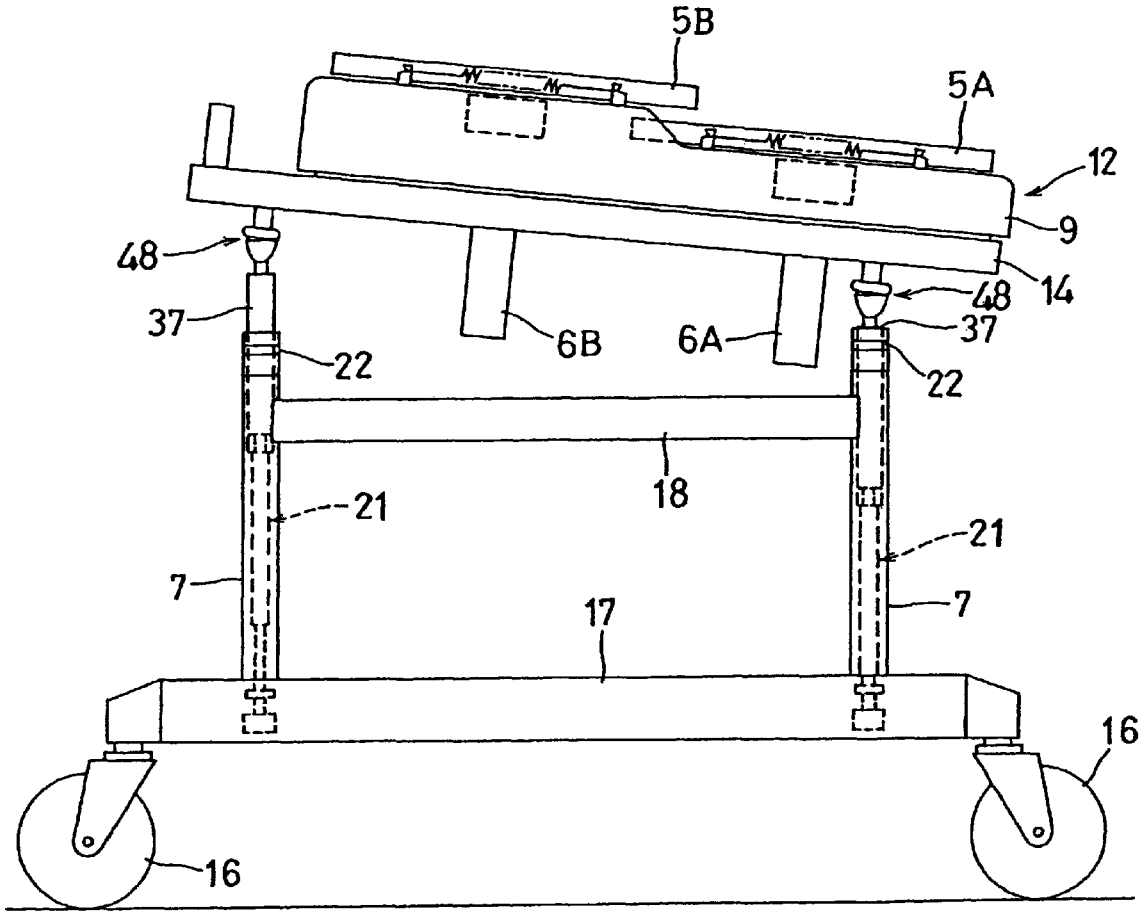
FIG. 5 is a side view of the musical instrument stand with its rear side raised so that the musical instrument mounting holder tilted toward the player for use.

Furthermore, with the universal joints 48 provided, the height position of the height adjustment devices 21 in the leg columns 7 on the front side and rear side can be set differently so that the musical instrument mounting holder 12 tilts toward the player (or tilted to the front) at an appropriate angle as shown in FIG. 5. Thus, the distance between the accidental-tone bars 5B on the rear side and the player (i.e., the eyes of the player) is shortened, and a new playing environment not obtainable in the case of conventional musical instrument stands can be created.

Figure 6:
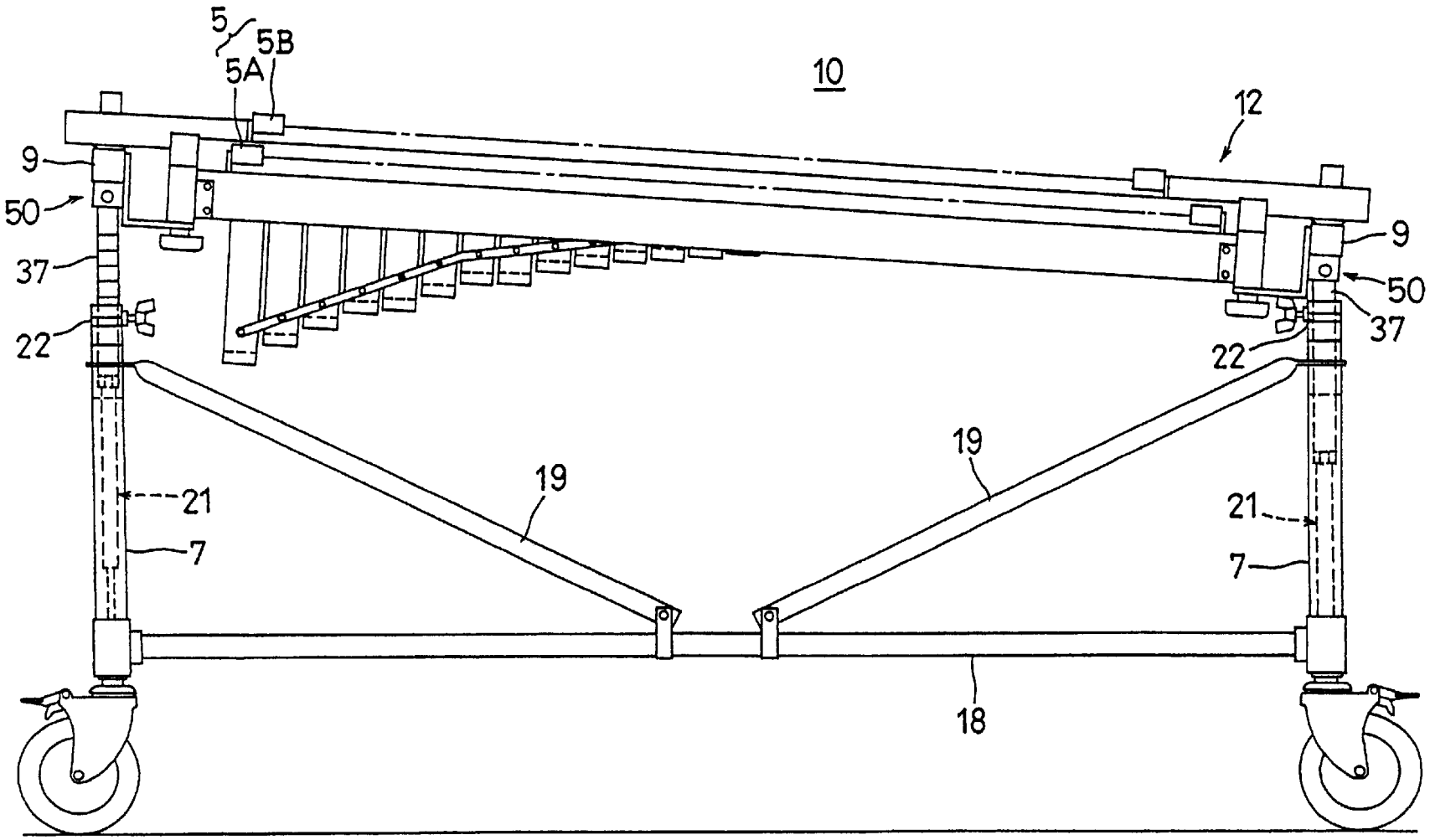
FIG. 6 is schematic front view showing another embodiment of the present invention.
Figure 7A:
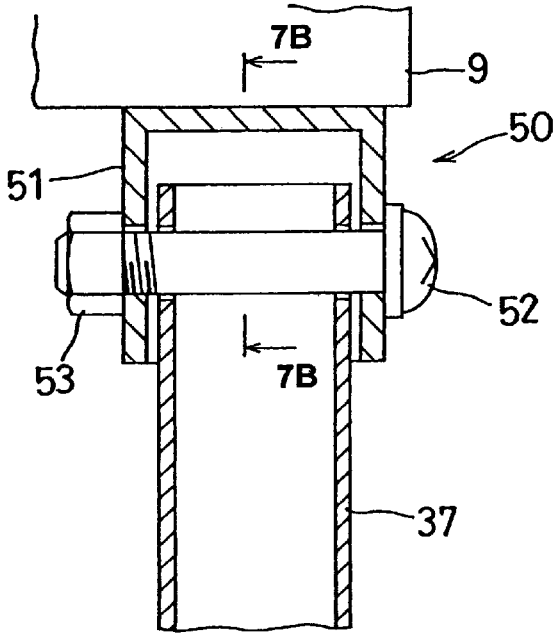
FIGS. 7A shows, in cross section, the angle adjustment mechanism used in the embodiment of FIG. 6.
Figure 7B:
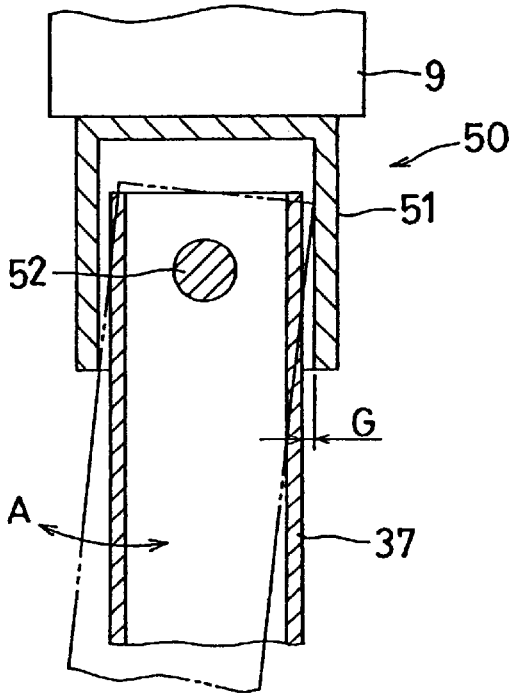
FIG. 7B is a cross-sectional view taken along the lines 7B—7B of FIG. 7A.

FIGS. 6, 7A and 7B show another embodiment of the present invention. In this embodiment, an angle adjustment assembly 50 is employed as an angle adjustment mechanism so that the angle of the musical instrument mounting holder 12 is adjusted, and the musical instrument mounting holder 12 tilts only in the left-right directions (one side, the low-tone side, for instance, higher or lower than another side).

The angle adjustment assembly 50, provided on each one of the height adjustment devices 21, is comprised of a supporting element 51, which is connected to the under surface of the side frame 9 of the musical instrument mounting holder 12, and a supporting shaft 52, which is horizontally held in the supporting element 51. The upper end of the supporting member 37 is pivotally connected to the supporting shaft 52 so that the musical instrument stand 11 can move only in the left-right directions.

The supporting element 51 is shaped as a box with its bottom opened. The supporting shaft 52 is a bolt and is set so that the axial direction of the supporting shaft 52 is the same as the front-rear direction of the musical instrument stand 11. In other words, the supporting shaft 52 is provided parallel to the lengthwise direction of the leg elements 17. The supporting shaft 52 is horizontally disposed by the facing side plates of the supporting element 51 and is prevented from coming out of the supporting element 51 by a nut 53 screwed to the tip end. The upper end of the supporting member 37 is brought into the supporting element 51 in spaced relationship with the inner surface of the supporting member 37 with a distance G in between and is pivotally connected to the supporting shaft 52. The spaces G allow the supporting member 37 to pivot in the direction of arrow A (in actual use, the supporting member 37 stays vertically, and the supporting element 51 pivots about the supporting shaft 52 with respect to the supporting member 37).

The structure of the musical instrument stand 11 is the same as that described with reference to FIGS. 1 through 5, and the description is not provided here.

With the structure described above, in order to set the musical instrument mounting holder 12 so that the high-tone side is lower than the low-tone side as shown in FIG. 6, the stoppers 22 screwed to the top ends of the leg columns 7 on the low-tone side are loosened, thus releasing the supporting members 37 being locked at the top ends of the leg columns 7. When the supporting members 37 on the low-tone side are thus released, the gas pressure inside the first chambers 33 acts as a driving force so that the cylinders 31 are pushed upward. Then, when the low-tone side of the musical instrument mounting holder 12 is raised to a desired height, the stoppers 22 are tightened back, so that the supporting members 37 are fastened at this height position. During this process, the supporting elements 51 pivot about the supporting shafts 52 with respect to the supporting members 37; and as a result, the musical instrument mounting holder 12 is set tilted as shown in FIG. 6.

Figure 8:
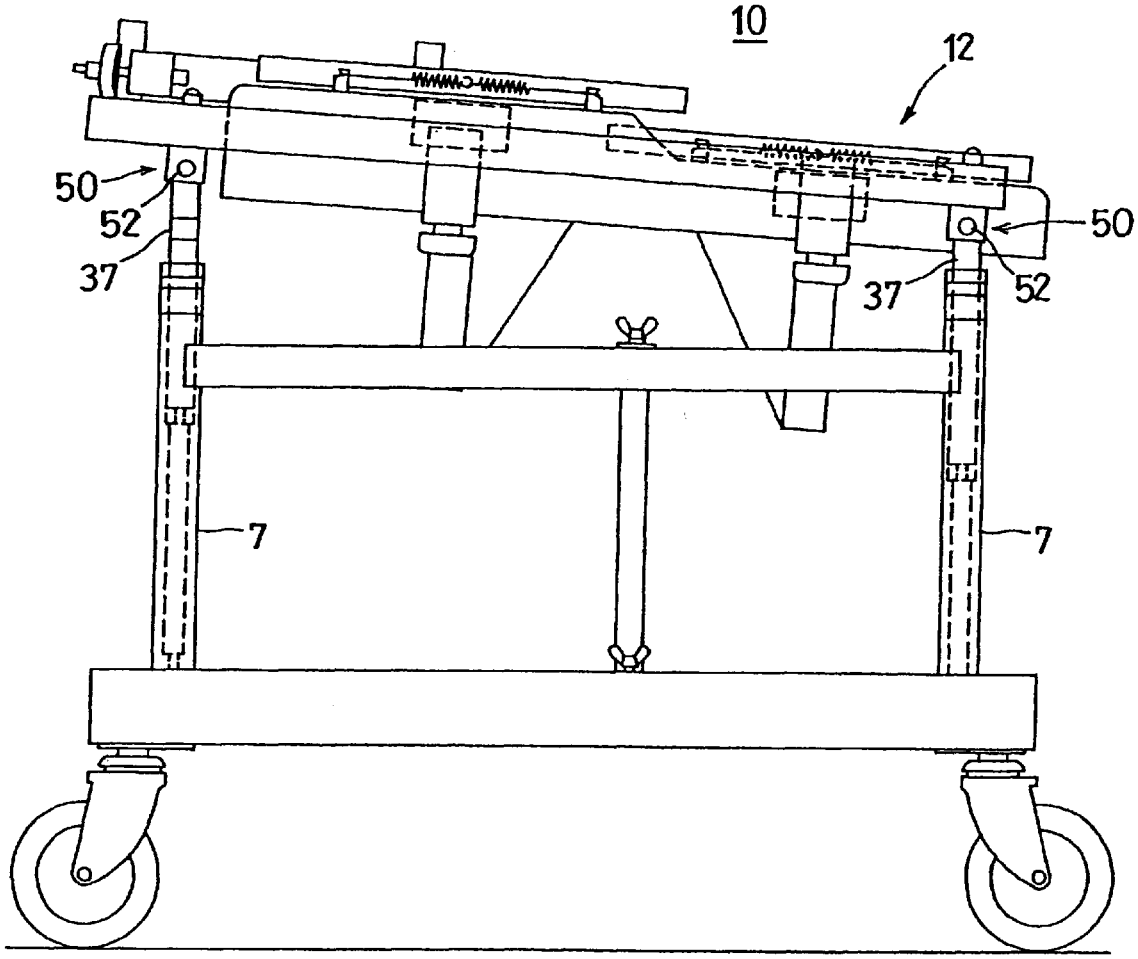
FIG. 8 is a side view of still another embodiment of the present invention.

FIG. 8 shows still another embodiment of the present invention.

In the embodiment of FIG. 8, when the angle adjustment assembly 50 is adjusted, the musical instrument mounting holder 12 tilts only in the front-rear directions (the front higher or lower than the rear side).

The angle adjustment assembly 50, provided on each one of the leg columns 7, is the same as the angle adjustment assembly 50 shown in FIGS. 6 and 7. The only difference is that in the embodiment of FIG. 8 the axial direction of the supporting shaft 52 is set so as to be in the left-right direction (or in the perpendicular direction of the drawing sheet of FIG. 8) of the musical instrument stand 11. In other words, the supporting shafts 52 are provided perpendicular to the lengthwise direction of the leg elements 17.

In this structure, when the supporting members 37 on the rear side (left side in FIG. 8) are raised by loosening the stoppers on the rear side, the musical instrument mounting holder 12 tilts toward the front or toward the player.

In the above embodiments, the present invention is described with reference to a musical instrument stand for marimbas. However, the present invention is not limited to this application; and it can be applied to musical instrument stands for xylophones, vibraphones, and the like.

Furthermore, in the above embodiments, gas springs that are commercially marketed are used as the height adjustment devices 21. However, it is also indeed possible to use gas springs of a different type than those shown in FIG. 3 or to use appropriate height adjustment devices other than the gas springs.

As seen from the above, the musical instrument stand of the present invention is endowed with a degree of freedom in the angles between the leg columns and the musical instrument mounting holder. Accordingly, adjustment of the height of the musical instrument mounting holder can easily be accomplished by a single person. Furthermore, the structure is simple; and with the use of universal joints, no special operation is required for the adjustment of the angles between the leg columns and the musical instrument mounting holder; and by way of tilting the musical instrument mounting holder in the front-rear directions or in the left-right directions, a new playing environment can be created.

What is claimed is:

1. A musical instrument stand comprising:

a musical instrument mounting holder that holds thereon a musical instrument;

a stand main body for supportliw said musical instrument mounting holder thereon, said stand main body comprising a pair of leg elements disposed parallel;

height adjustment devices respectively provided in each one of said leg elements;

an angle adjustment assembly provided between said musical instrument mounting holder and said stand main body, said angle adjustment assembly allowing said musical instrument mounting holder to tilt in any direction with respect to said leg elements; and stoppers provided at upper ends of said leg elements so as to keep said height adjustment devices at desired height positions.

2. The musical instrument stand according to claim 1, wherein said angle adjustment mechanism supports said musical instrument mounting holder so that said angle of said musical instrument mounting holder is adjusted in front-rear direction or left-right direction.

3. The musical instrument stand according to claim 1, wherein said angle adjustment mechanism supports said musical instrument mounting holder so that said angle of said musical instrument mounting holder is adjusted in any desired direction.

4. The musical instrument stand according to claim 1, wherein said angle adjustment mechanism is a universal joint.

5. The musical instrument stand according to claim 3, wherein said angle adjustment mechanism is a universal joint.

6. A musical instrument stand comprising:

a musical instrument mounting holder which is substantially a rectangular frame that holds thereon a musical instrument;

a stand main body for supporting said musical instrument mounting holder thereon, said stand main body comprising a pair of leg elements disposed parallel and equipped with casters, a pair of leg columns installed vertically on each one of said leg elements, and horizontal connecting bars that connect upper portions of said leg columns to each other;

height adjustment devices respectively provided in each one of said leg columns so as to project out of and retract into each one of said leg columns;

at angle adjustment assembly provided between said musical instrument mounting holder and each of said height adjustment devices, said angle adjustment assembly allowing said musical instrument mounting holder to tilt in any direction with respect to said leg columns; and stoppers provided at upper ends of said leg columns so as to keep said height adjustment devices at desired height positions.

7. The musical instrument stand according to claim 6, wherein said angle adjustment assembly is a universal joint that is comprised of a spherical surface seat, which is of a bowl shape and fastened to an upper surf bee of a supporting member that is connected to each one of said height adjustment devices, and a spherical surface element, which has a spherical surface portion that slidably engages with said spherical-surface seat and is attached to an undersurface of said musical instrument mounting holder.

8. The musical instrument stand according to claim 6, wherein said angle adjustment assembly is comprised of a box shape supporting element, which is connected to said musical instrument mounting holder, and a supporting shaft; which is horizontally disposed in said supporting element with one end of a supporting member provided on each one of said height adjustment devices being pivotally connected to said horizontal supporting shaft.

9. The musical instrument stand according to claim 8, wherein said supporting shaft is disposed parallel to said leg elements.

10. The musical instrument stand according to claim 8, wherein said supporting shaft is disposed perpendicular to said leg elements.

11. The musical instrument stand according to claim 1, further comprising:

a pair of leg columns installed vertically on each one of said leg elements, and horizontal connecting bars that connect upper portions of said leg columns to each other.

* * * * *